United States Patent [19]

Tipper

[11] 4,312,108

[45] Jan. 26, 1982

[54] CLIPPING DEVICE

[76] Inventor: Maynard J. G. Tipper, Oakland, Calif. 94010

[21] Appl. No.: 197,830

[22] Filed: Oct. 17, 1980

[51] Int. Cl.[3] ..... B23P 11/00

[52] U.S. Cl. ..... 29/243.56; 53/138 A

[58] Field of Search ..... 29/243.56; 53/138 A

[56] References Cited

U.S. PATENT DOCUMENTS 3,237,290 3/1966 Frank ..... 53/138 A 3,455,010 7/1969 Busler ..... 53/138 A

FOREIGN PATENT DOCUMENTS 1134622 8/1962 Fed. Rep. of Germany ... 53/138 A

*Primary Examiner*—James L. Jones, Jr.

[57] ABSTRACT

A clipping device for applying a U-shaped clip to a flexible casing, bag, or the like. A gathering plate, secured to the punch, is shaped to progressively gather the material to be clipped as the punch moves toward the die so as to squeeze the material to a relatively small cross section at the point where the clip is applied to the material.

2 Claims, 3 Drawing Figures

Fig. 1.
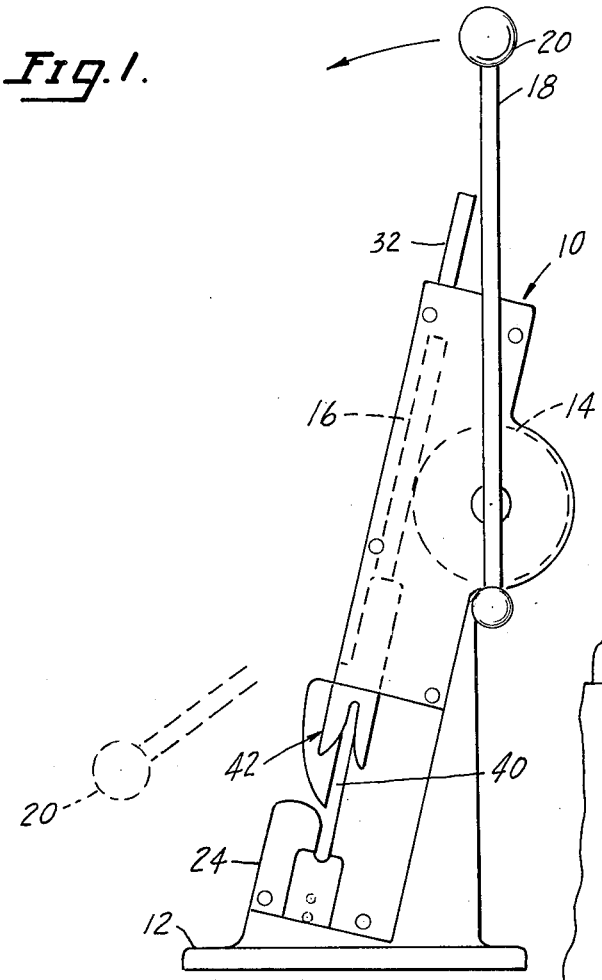
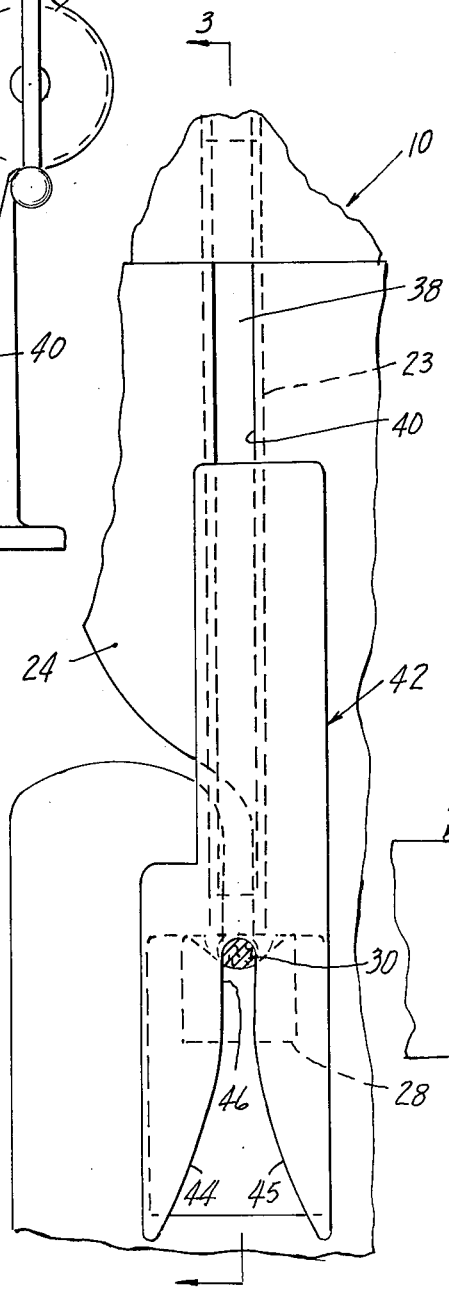
Fig. 2.
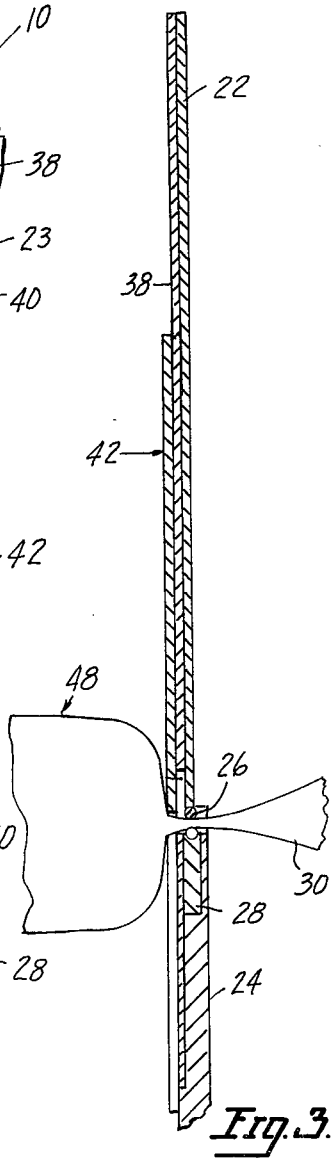
Fig. 3.

CLIPPING DEVICE

This invention relates to clipping devices of the type employed to secure an initially U-shaped clip around the neck of a bag, casing or other flexible material.

In the conventional device for applying clips of the subject type a U-shaped clip is driven along a track into engagement with a stationery die with the material to be clipped between the legs of the clip so that the legs of the clip are deformed into encircling relation with such material. For a successful operation of this type it is important that the material be gathered and squeezed to as small a cross section as possible between the legs of the clip to obviate any interference between the clip legs and the material thus preventing any damage to the latter.

The main object of the present invention is therefore to provide a clipping device provided with means for gathering and squeezing the material to be clipped prior to the clipping step so that the punch may deform the clip legs around the material without injury to the material.

Another object is the provision of a simple inexpensive gathering plate which is carried by the punch so that the power of the clipping device is employed to perform the gathering step.

Still another object is the provision of a clipping device in which the clip itself is not relied on to perform a substantial portion of the gathering function thereby reducing the friction between clip and clip track during the clipping step.

Another object is the provision of a gathering means for a clipping device which permits the gathered material to be aligned more accurately with reference to the clip than could be accomplished heretofore when the gathering was performed manually.

Other objects and advantages will be apparent from the following specification and drawings:

FIG. 1 is side elevation of a clipping device incorporating the invention.

FIG. 2 is a greatly enlarged side elevation of a portion of the structure of FIG. 1 showing the gathering plate in its clip applying position.

FIG. 3 is a cross section taken in a plane indicated by lines 3—3 of FIG. 2.

In detail, and first with reference to FIG. 1, a manually operated clipping device is shown which includes an upstanding frame 10 provided with a base 12 for supporting the device on a table or the like.

Within the frame 10 there is rotatably supported a pinion 14 which is in mesh with a slidably supported rack 16. Connected to the pinion 14 is an elongated arm 18 provided at one end with a knob 20 adapted to be grasped by an operator so that the pinion 14 may be rotated counterclockwise to drive the rack 16 downwardly as arm 18 is swung from the upper full line position to the lower dotted line position.

Attached to rack 16 is an elongated punch 22 (FIG. 3) slidably received in a clip track 23 formed in a die support 24. This die support 24 is fixedly secured to frame 10. The punch 22 is adapted to force a clip 26 against a die 28 with the material 30 to be clipped between the legs of the clip.

Upon downward movement of the punch 22 from its upper position it picks up one of a stack of clips on a clip rail 32 (FIG. 1) and drives it along the track 23 in the die support 24 to the clipping position of FIGS. 2, 3.

The above described structure is conventional and no claim is made thereto except as the same is used in combination with the invention now to be described.

Fixedly secured to the outer side of punch 22 is an elongated spacer 38 which is adapted to slide within a slot 40 parallel to and communicating with the clip track 23 in die support 24. Fixed to the outer side of spacer 38 is a gathering plate 42 which is thus adapted to travel along the outer side of die support 24. As best seen in FIG. 2 this gathering plate 42 is formed with a relatively broad mouth having a pair of downwardly diverging edges 44, 45 which are gradually curved as indicated and which terminate in a relatively narrow inner slot portion 46.

In operation, and assuming the casing of a chub 48 is to be sealed, as the punch 22 is driven downwardly toward die 28 the material 30 to be clipped is engaged by the side edges 44, 45 of the gathering mouth and squeezed into the relatively small cross sectional area of the inner slot portion 46.

Although the device has been described with reference to a butt type clip it will be apparent that it may be employed with other types of clips and dies including those in which the legs of the deformed clip are brought into side by side parallel relation by the interaction of punch and die.

Also, it is apparent that the structure and operation of the device would be the same in a power driven device as in the above disclosed manually operated device.

It will be apparent that the above described apparatus not only provides a simple means for carrying out the gathering step but it also insures that the gathered material is aligned accurately relative to the clip and that interference between the clip legs and the material that might otherwise result in perforation of the material is obviated.

I claim:

1. In a clipping device for applying a U-shaped clip to an article of deformable material:

a frame formed with an elongated track, an elongated punch slidably received in said track, a die fixedly secured to said frame at one end of said track, said frame being formed with a throat terminating at said die and adapted to receive such article therein, for positioning said article at said die, and a gathering plate carried directly by said punch and formed with an outwardly diverging recess means to receive said article therein for gathering and compressing the same to a relatively small cross sectional area upon movement of said punch toward said die.

2. The clipping device according to claim 1 wherein a spacer is interposed between said punch and said plate, said frame being formed with a slot parallel to and communicating with said track for receiving said spacer therein.

* * * * *